US006449803B1

(12) United States Patent
McConchie

(10) Patent No.: US 6,449,803 B1
(45) Date of Patent: Sep. 17, 2002

(54) GRIP FOR A HANDLE OR SHAFT

(75) Inventor: Ian Ross McConchie, Preston (AU)

(73) Assignee: The Grip Master Company Pty. Ltd., Preston (AU)

( * ) Notice: Subject to any disclaimer, the term of this patent is extended or adjusted under 35 U.S.C. 154(b) by 0 days.

(21) Appl. No.: 09/720,854

(22) PCT Filed: Jul. 1, 1999

(86) PCT No.: PCT/AU99/00531

§ 371 (c)(1),
(2), (4) Date: Feb. 12, 2001

(87) PCT Pub. No.: WO00/01511

PCT Pub. Date: Jan. 13, 2000

(30) Foreign Application Priority Data

Jul. 1, 1998 (AU) ..... PP 4427

(51) Int. Cl.[7] ..... B25G 1/01; A47J 45/00

(52) U.S. Cl. ..... 16/431; 16/421; 473/301; 473/549; 473/568

(58) Field of Search ..... 16/431, 430, 436, 16/421, DIG. 12, DIG. 41; 473/300, 301, 302, 538, 549, 568

(56) References Cited

U.S. PATENT DOCUMENTS

| | | | | | |
|---|---|---|---|---|---|
| 4,537,400 | A | * | 8/1985 | Adam | 273/301 |
| 5,000,452 | A | * | 3/1991 | Kuebler | 473/301 |
| 5,083,780 | A | * | 1/1992 | Walton et al. | 273/DIG. 23 |
| 5,295,684 | A | * | 3/1994 | Bracho | 473/549 |
| 5,542,676 | A | * | 8/1996 | Howe et al. | 340/665 |
| 5,671,923 | A | * | 9/1997 | Huang | 273/301 |
| 5,730,662 | A | * | 3/1998 | Rens | 16/DIG. 12 |
| 5,816,933 | A | * | 10/1998 | Huang | 473/301 |
| 5,895,329 | A | * | 4/1999 | Huang | 473/302 |

* cited by examiner

*Primary Examiner*—Chuck Y. Mah
(74) *Attorney, Agent, or Firm*—Milde & Hoffberg, LLP

(57) ABSTRACT

The invention provides a grip for a handle or shaft including (a) core means (10) adapted to be fitted to the handle or shaft, and (b) a strip of material (22) to form the outer surface for the grip, to be wound around the handle or shaft and/or said core (10) to provide, in use, a wound grip. The core means (10) has a first end (16) and a second end (11) and a body (14) therebetween. The core means also has a peripheral flange at the second end (11) in the form of a skirt (12) which is adapted, in use, to be flexed over the wound strip (22) to prevent unwinding thereof from the handle or shaft and/or the core means (10).

9 Claims, 1 Drawing Sheet

GRIP FOR A HANDLE OR SHAFT

BACKGROUND OF THE INVENTION

This invention relates to a grip to be applied to a handle or shaft and relates in one aspect, though not exclusively, to a grip for an article of sporting equipment.

The invention particularly relates to a grip which employs a strip of material to be wound around the handle or shaft in an overlapping manner, as the outer component of the grip. Such grips will hereinafter be referred to as "wound grips".

Wound grips have been known and used on handles and shafts, especially on sporting equipment, for many years and as will be appreciated by those skilled in the art it is necessary to secure at least one, and preferably both ends of a wound grip to prevent the grip from pealing from one or both ends and eventually unwrapping.

SUMMARY OF THE INVENTION

It is an object of the invention to provide a construction of wound grip which may be readily applied to a handle or shaft, which includes means for securing one end, or alternatively both ends. of the strip material used as the outer component of the wound grip.

According to the invention there is provided a grip for a handle or shaft, said grip including a core means adapted to be fitted to said handle or shaft and a strip of material to form the outer surface of said grip, to be wound around said handle or shaft and/or said core to provide, in use, a wound grip; said core means having a first end, a second end and a body therebetween, and having a peripheral flange at said second end in the form of a skirt, said strip to be wound on said handle or shaft and/or said core means; said peripheral flange adapted, in use, to be flexed over said wound strip to prevent unwinding of said strip from said handle or shaft and/or said core means.

In a preferred embodiment of the invention the core means is positioned over said handle or shaft in the area where the grip is to be applied.

In another preferred embodiment of the invention the core means, other than the end carrying said peripheral flange, is positioned within the handle or shaft.

In a further preferred embodiment of the invention the core means positioned over the handle or shaft is provided at its first end with an enlarged collar, against which said strip of material is abutted while commencing winding, thereof on said core means.

In a still further preferred embodiment of the invention the core means is formed of resilient material so as to be readily applied over a handle or shaft and also to provide a "soft" component to the feel of the finished grip.

The invention also provides a method of forming a grip on a handle or shaft which includes the steps of:

(i) positioning a core means on or partly in a handle or shaft in the area where a grip is required; said core means having a first end, a second end and a body therebetween, and having a peripheral flange at said second end in the form of a skirt;

(ii) winding a strip of material in an overlapping manner over said handle or shaft and/or said core means, towards said second end;

(iii) flexing said skirt so that it is positioned over said wound strip of material, to hold said strip of material against said handle or shaft and/or said core means and prevent unwinding thereof.

Those skilled in the art will appreciate that an adhesive material may be provided on the underside of the strip material so that the strip material is to some extent adhered to the core or the handle or shaft as it is wound thereupon.

For a full understanding of the present invention, reference should now be made to the following detailed description of the preferred embodiments of the invention as illustrated in the accompanying drawings.

DESCRIPTION OF THE PREFERRED EMBODIMENT

Figure 1:
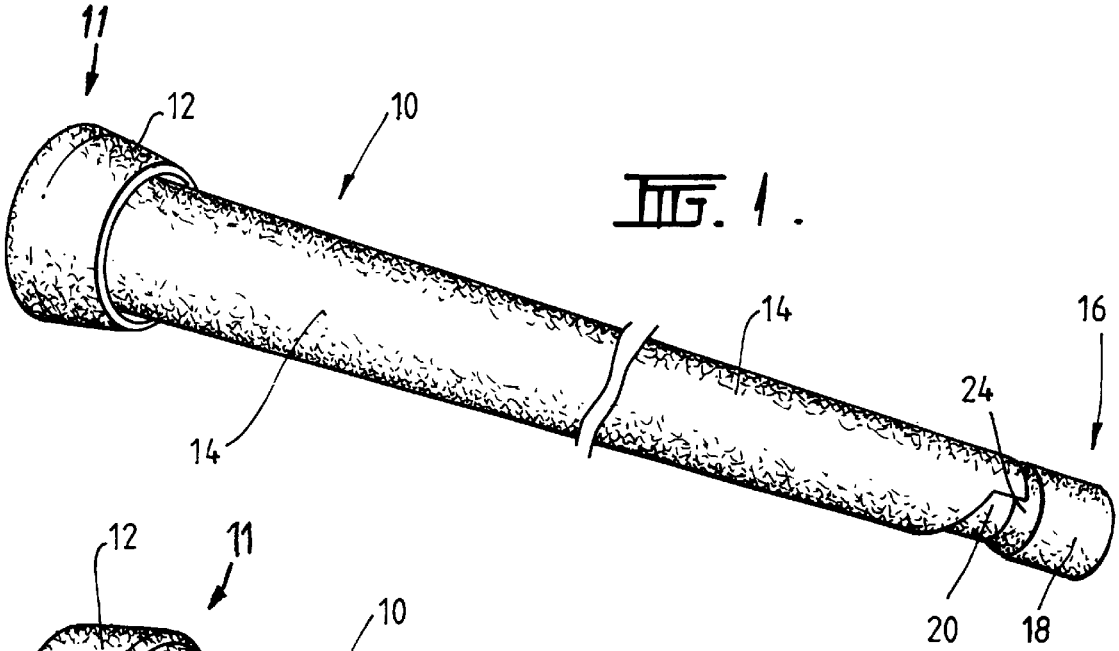
FIG. 1 shows a core means in accordance with a first embodiment of the invention designed to be used to produce a grip on the shaft of a golf club.

The preferred embodiments of the present invention will now be described with reference to FIGS. 1–5 of the drawings. Identical elements in the various figures are designated with the same reference numerals.

Figure 2:
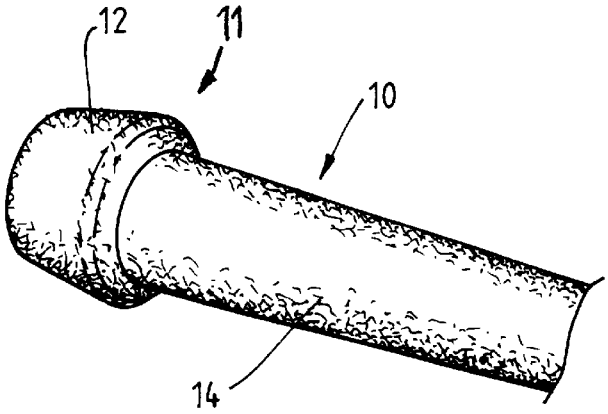
FIG. 2 shows one end of the core means of FIG. 1 showing the skirt in its flexed away position.

Referring now to FIGS. 1 and 2 of the drawings, there is shown a core means 10 having a body 14, a first end 16 and a second end 11, and having a flange formed as a skirt 12 at end 11 which overlies part of body 14.

Core 10 is hollow (not seen in the drawings) and, in use, is fitted over one end of the shaft of a golf club, in order to provide a grip to the shaft. Core 10 is made from a resilient material and is applied to the shaft using known techniques, which may involve use of a lubricant/adhesive composition.

First end 16 is provided with an enlarged collar 18.

Referring now to FIG. 1, it will be seen that adjacent collar 18, body 14 is recessed at 20 to accommodate the starting end of a strip material 22 which is to be used to provide the wound grip of the invention. Recess 20 allows the starting end of strip material 22 to be accommodated underneath the initial overlap as strip material 22 is wound onto core 10, without creating a lump or bulge in the finished grip at that position. Collar 18 is slightly tapered and shoulder 24 of collar 18 is of the same dimension as the thickness of strip material 22 so that in the finished grip the outer surface of strip material 22 is flush with collar 18 where they abut.

FIG. 2 shows skirt 12 flexed back and away from second end 11 and core 10, in order to allow strip material 22 to be wound to the end of body 14. Strip 22 is then trimmed to finish where it abuts skirt 12, or, is of a length which only extends as far as skirt 12. While strip material 22 is held against body 14 skirt 12 is flexed back over body 14 to the position shown in FIG. 3, over the end of strip material 22, to hold strip material 22 in place against body portion 14 and prevent strip material 22 from unwinding.

Figure 4:
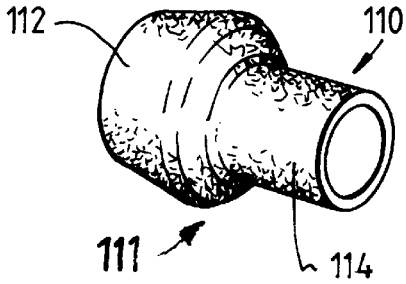
FIG. 4 shows a core means in accordance with second embodiment of the invention.

Referring now to FIG. 4 there is shown a second embodiment of the invention, (where like parts are referred to by like numbers with a prefix of 1) in which, in use, body 114 of core 110 again is fitted over the end of a shaft of a golf club but only extends down to form the grip is applied directly to the shaft for the substantial majority of the grip.

Figure 3:
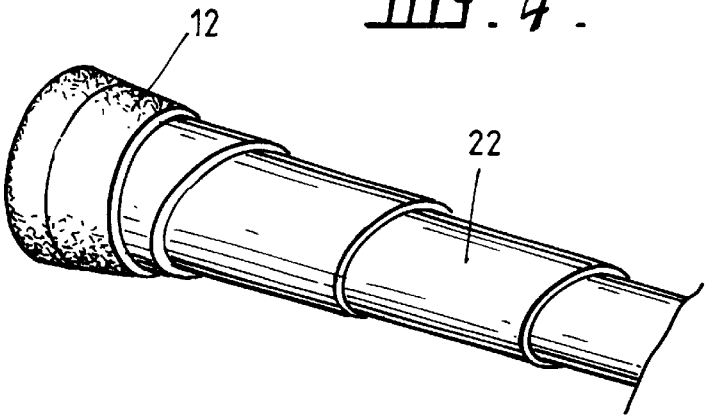
FIG. 3 shows the end of a finished grip utilising the core means shown in FIG. 2, with a wound strip material thereon and the skirt flexed back.

Core 110 is positioned at the and of the golf club shaft and winding of the strip material commences further down the handle or shaft towards core 110 and finishes when body 114 is covered by the wound strip material, in like manner to that described in FIGS. 1 to 3. Skirt 112 which has been flexed away from second end 111 and body 114 is then flexed back over the wound strip material to hold the strip material (not shown in FIG. 4) in place against body 114. While a slight enlarging of the finished grip may occur at the end where core 110 is positioned, this is considered acceptable in situations where core 110 is employed.

Figure 5:
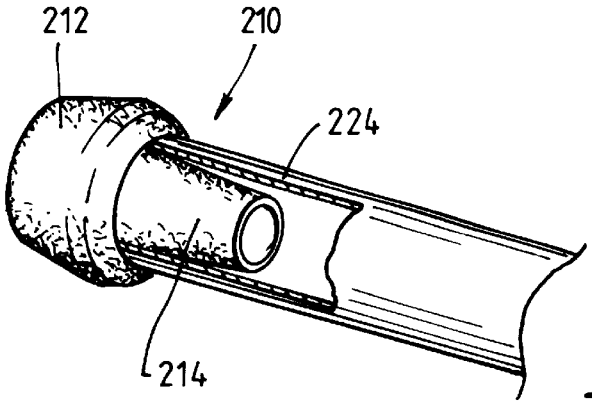
FIG. 5 shows a core means in accordance with a third embodiment of the invention intended for use with a golf club shaft having a hollow portion at the grip end thereof.

FIG. 5 shows a third embodiment of the invention, (again like parts are referred to by like number with a prefix of 2). There is seen a core 210 having a body 214 which is positioned inside shaft 224 (shown in cut-away section) such that core 210 is at the end of shaft 224, so that shaft 224 is ready to receive the strip material (not shown) which forms the outside surface of the grip. As in the second embodiment of the invention referred to above, the strip material is applied directly to shaft 224.

When the strip material is wound on shaft 224 to reach core 210 it is trimmed to the end of shaft 224 (if necessary). Skirt 212 is flexed back in a similar manner described above, to hold the wound strip material in place against shaft 224.

A further advantage of this preferred embodiment of the invention, and particularly in relation to golf clubs, is that by commencing winding of the strip material down the shaft of the golf club and winding back toward the end of the shaft, the overlapping of the strip lies in such a way that, in use, the grip of the golf club is formed so that water running down the grip from the end of the shaft, such as when using the golf club in the rain, runs over the overlap in the grip without being directed under the strip material. As will be appreciated by those skilled in this art, in previously wound grips, which commence winding and overlapping from the end of the shaft core overlap configuration tends to direct water running down the grip underneath the wound material which forms the grip.

To assist in holding the strip material 22 on core 10 adhesive may be applied to the underside of strip 22, or to the outer surface of body 14, in a known manner.

Also, the invention provides for a further embodiment of the invention in which a core member as described in FIGS. 1 to 3 may be provided at both ends with a peripheral skirt which, in both cases, can be flexed away from the body portion of the core to allow wrapping of the strip material onto the core, and then be flexed back to hold the ends of the strip material against the core, and prevent the strip material from peeling away and eventually unwinding.

While the above described preferred embodiments have been described in relation to the grip for a golf club, it will be appreciated that all sporting articles which have a handle or a shaft portion which requires a grip, such as tennis racquets, squash racquets, badminton racquets, hockey sticks, baseball and softball bats, and the like may be provided with a grip in accordance with the present invention.

Also, items such as the handlebars of bicycles, the handle portion of hand tools, the throwing grip portion of a Javelin, and, in fact, any article or device having a handle or shaft portion on which a grip is desirable, may employ the grip of the present invention, and employ the method of forming a grip as provided for by the present invention.

There has thus been shown and described a novel grip for a handle or shaft which fulfills all the objects and advantages sought therefor. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

What is claimed is:

1. A grip for a handle or shaft, said grip including core means adapted to be fitted to said handle or shaft and a strip of material wound around at least one of said handle, said shaft and said core means to provide, in use, a wound grip; said core means having a first end and a second end and a body therebetween, and having a peripheral flange at said second end in the form of a skirt; said strip being wound toward said second end of said core means on at least one of said handle, said shaft and said core means; and said peripheral flange being adapted, in use, to be flexed from a position where the skirt is directed away from said first end while said strip is applied to said at least one of said handle, said shaft and said core means, to a position where the skirt is directed toward said first end, and over said wound strip to prevent unwinding of said strip from said at least one of said handle, said shaft and said core means.

2. A grip as claimed in claim 1 wherein said core means is fitted over said handle or shaft.

3. A grip as claimed in claim 1 wherein said core means, other than said second end thereof and said skirt, is positioned within the end of said handle or shaft.

4. A grip as claimed in claim 1 wherein said core means is formed from resilient material.

5. A method of forming a grip on a handle or shaft which includes the steps of:

(i) positioning core means on or partly in a handle or shaft in the area where a grip is required; said core means having a first end, a second end and a body therebetween, and having a peripheral flange at said second end in the form of a skirt, which skirt, in use, partly overlies at least one of a part of said body of said core means and a part of said handle and said shaft;

(ii) winding a strip of material in an overlapping manner over at least one of said handle, said shaft and said core means, towards said second end; and (iii) flexing said skirt so that it is positioned over said wound strip of material, to hold said strip of material against said at least one of said handle, said shaft and said core means and prevent unwinding thereof.

6. A method as claimed in claim 5 wherein said core means is fitted over said handle or shaft.

7. A method as claimed in claim 5 wherein said core means, other than said second end thereof and said skirt, is positioned within the end of said handle or shaft.

8. A method as claimed in claim 5 wherein said core means is formed from resilient material.

9. A grip produced by the method as claimed in claim 5.

* * * * *